US006706376B1

(12) United States Patent
Von Fransecky

(10) Patent No.: US 6,706,376 B1
(45) Date of Patent: Mar. 16, 2004

(54) TEXTILE MESH STRUCTURE, IN PARTICULAR, A GEOTEXTILE

(75) Inventor: Ulrich Von Fransecky, Bocholt (DE)

(73) Assignee: Huesker Synthetic GmbH, Gescher (DE)

( * ) Notice: Subject to any disclaimer, the term of this patent is extended or adjusted under 35 U.S.C. 154(b) by 0 days.

(21) Appl. No.: 09/926,279

(22) PCT Filed: Mar. 17, 2000

(86) PCT No.: PCT/EP00/02395

§ 371 (c)(1),
(2), (4) Date: Dec. 6, 2001

(87) PCT Pub. No.: WO00/61850

PCT Pub. Date: Oct. 19, 2000

(30) Foreign Application Priority Data

Apr. 8, 1999 (DE) ..... 199 15 722

(51) Int. Cl.[7] ..... B32B 7/02

(52) U.S. Cl. ..... 428/212; 428/220; 442/2; 442/35; 442/203

(58) Field of Search ..... 428/212, 220; 442/2, 35, 203

(56) References Cited

U.S. PATENT DOCUMENTS

| | | | |
|---|---|---|---|
| 4,306,429 | A | 12/1981 | Warsop |
| 4,433,493 | A | 2/1984 | Poisson |
| 4,472,086 | A | 9/1984 | Leach |
| 4,540,311 | A | 9/1985 | Leach |
| 5,110,656 | A | 5/1992 | Inaba et al. |
| 5,244,693 | A | 9/1993 | Inaba et al. |
| 5,795,835 | A | 8/1998 | Bruner et al. |
| 5,965,467 | A | 10/1999 | Stevenson et al. |
| 6,020,275 | A | 2/2000 | Stevenson et al. |
| 6,056,479 | A | 5/2000 | Stevenson et al. |
| 6,250,117 | B1 | 6/2001 | Wunner |

FOREIGN PATENT DOCUMENTS

| | | |
|---|---|---|
| DE | 19530541 | 2/1997 |
| DE | 19652584 | 6/1998 |
| DE | 19816440 | 7/1999 |
| EP | 0791673 | 8/1997 |
| FR | 2076016 | 10/1971 |
| WO | 96/35833 | 11/1996 |
| WO | 97/07269 | 2/1997 |

*Primary Examiner*—Ula C. Ruddock
(74) *Attorney, Agent, or Firm*—Greenblum & Bernstein, P.L.C.

(57) ABSTRACT

The invention relates to, in particular, a geotextile comprising linear running warp threads (1) and linear running weft threads (2) which are essentially orthogonal thereto. Said weft threads are joined to the warp threads (1) by means of fixing threads (3) which are applied by warp knitting and whose meshes wrap around the warp threads (1) along the entire length and around the weft threads (2) in the area of crossings (4). The warp threads (1) and the weft threads (2) are arranged individually or in groups in larger intervals which result in inner widths (5) of the mesh (6). The aim of the invention is to attain an improved joining of warp threads and weft threads without requiring the use of additional fixing threads or stronger fixing threads. To this end, the invention provides that, in the areas in which the weft threads (2) cross the warp threads (1), the lengths of the meshes (7) of the fixing threads (3) are distinctly shorter than the lengths in the areas of the mesh structure which are located therebetween.

20 Claims, 2 Drawing Sheets

TEXTILE MESH STRUCTURE, IN PARTICULAR, A GEOTEXTILE

CROSS-REFERENCE TO RELATED APPLICATIONS

The present application is a U.S. National Stage Application of International Application No. PCT/EP00/02395 filed Mar. 17, 2000 and claims priority under 35 U.S.C. §119 of German Patent Application No. 199 15 722.7 filed Apr. 8, 1999.

BACKGROUND OF THE INVENTION

1. Field of the Invention

The invention relates to a textile mesh structure, in particular a geomesh, comprising linearly extending warp threads and weft threads which extend linearly substantially at a right angle to the warp threads and which are joined to the warp threads by means of fixing threads which are applied by warp knitting and the meshes of which extend around the warp threads over the entire length and the weft threads in the region of the intersections, wherein the warp threads and the weft threads are arranged individually or in groups at relatively large spacings which produce the internal widths of the mesh.

2. Discussion of Background Information

Textile mesh structures of that kind are known from U.S. Pat. Nos. 4,472,086 and 4,540,311. The linearly extending and load-carrying warp threads and weft threads of the mesh preferably comprise high-module polyester yarns or other high-strength filament yarns, for example of polyamide. The fixing thread which is knitted onto the structure and which joins the warp threads to the weft threads in the form of knitted meshes or tricot meshes is considerably weaker in terms of its thread strength than the warp threads and the weft threads.

If necessary that mesh structure after manufacture thereof is encased with a soft plastic material, for example PVC, with a bitumen emulsion or with latex.

SUMMARY OF THE INVENTION

The present invention provides a better join between the warp threads and the weft threads without requiring additional fixing threads or stronger fixing threads.

In accordance with the invention, in the regions in which the weft threads cross the warp threads, the lengths of the meshes of the fixing threads are markedly shorter than in the regions which are therebetween.

Advantageously, the length of the meshes of the fixing threads in the regions in which the weft threads cross the warp threads is at least 30% shorter than the length of the meshes between the intersection regions. That measure provides for a considerable saving in terms of fixing threads or fixing yarn without any fear of an adverse influence on the strength of the mesh structure. The manufacturing speed of those textile mesh structures is also increased.

The present invention is directed to a textile mesh structure including linearly extending warp threads, linearly extending weft threads positioned substantially at a right angle to the warp threads, and fixing threads arranged to join the warp and weft threads. The fixing threads are applied by warp knitting to form a thread meshes, and the thread meshes are arranged to extend around the warp threads over an entire length of the warp threads and around the weft threads in a region in which the warp threads and weft threads intersect. The warp threads and the weft threads are arranged one of individually or in groups at relatively large spacings in order to form internal widths. In the regions in which the warp thread and the weft threads intersect, lengths of the thread meshes are shorter than in regions between the intersect regions.

According to a feature of the invention, the textile mesh is structured as a geomesh.

Further, the lengths of the thread meshes in the intersect regions are at least 50% shorter than the lengths of the meshes between the intersect regions.

In the intersect region, the lengths of the thread meshes are structured and arranged such that a mesh is associated with each weft thread. Moreover, the weft threads are arranged in weft thread groups including a plurality of weft threads, and the lengths of the thread meshes are structured and arranged such that a mesh is associated with each weft thread of the weft thread group.

According to another feature of the invention, a fixing thread is associated with each warp thread to form a warp mesh.

The warp threads are arranged in warp groups including at least two warp threads positioned in closer relation to each other than to adjacent warp groups. Further, a joining thread is arranged in a zig-zag configuration to prevent lateral displacement of the warp threads of the warp group. The fixing threads of the warp group are associated with each warp thread. Moreover, the joining thread extends in a zig-zag configuration to prevent lateral displacement of the fixing threads.

According to still another feature of the instant invention, a non-woven material layer is included, and one of the joining threads and the fixing threads are one of knitted on applied by Raschel knitting to join the warp and the weft threads to the non-woven material layer.

The present invention is directed to a process for forming a textile mesh structure including linearly extending warp threads, linearly extending weft threads at substantially a right angle to the warp threads, and warp knitting fixing threads to join the warp and weft threads, such that thread meshes are formed. The thread meshes are arranged to extend around the warp threads over an entire length of the warp threads and around the weft threads in a region in which the warp threads and weft threads intersect, and, in the regions in which the warp thread and the weft threads intersect, lengths of the thread meshes are formed to be shorter than in regions between the intersect regions.

According to a feature of the instant invention, the warp threads and the weft threads are arranged one of individually and in groups, such that, spacing between threads in a group is smaller than spacing between adjacent groups.

In accordance with another feature of the invention, the process includes arranging a joining thread in a zig-zag configuration to prevent lateral displacement of the warp threads of a warp group.

Moreover, the process includes arranging a joining thread in a zig-zag configuration to prevent lateral displacement of the fixing threads.

In accordance with still yet another feature of the present invention, the process includes joining the warp and weft threads to a non-woven material layer. Further, the joining includes one of knitting on and applying by Raschel knitting.

Further features of the invention are set forth in the claims.

BRIEF DESCRIPTION OF THE DRAWINGS

An embodiment of the invention is described in greater detail in the description hereinafter with reference to the drawings in which.

DETAILED DESCRIPTION OF THE INVENTION

Figure 1:
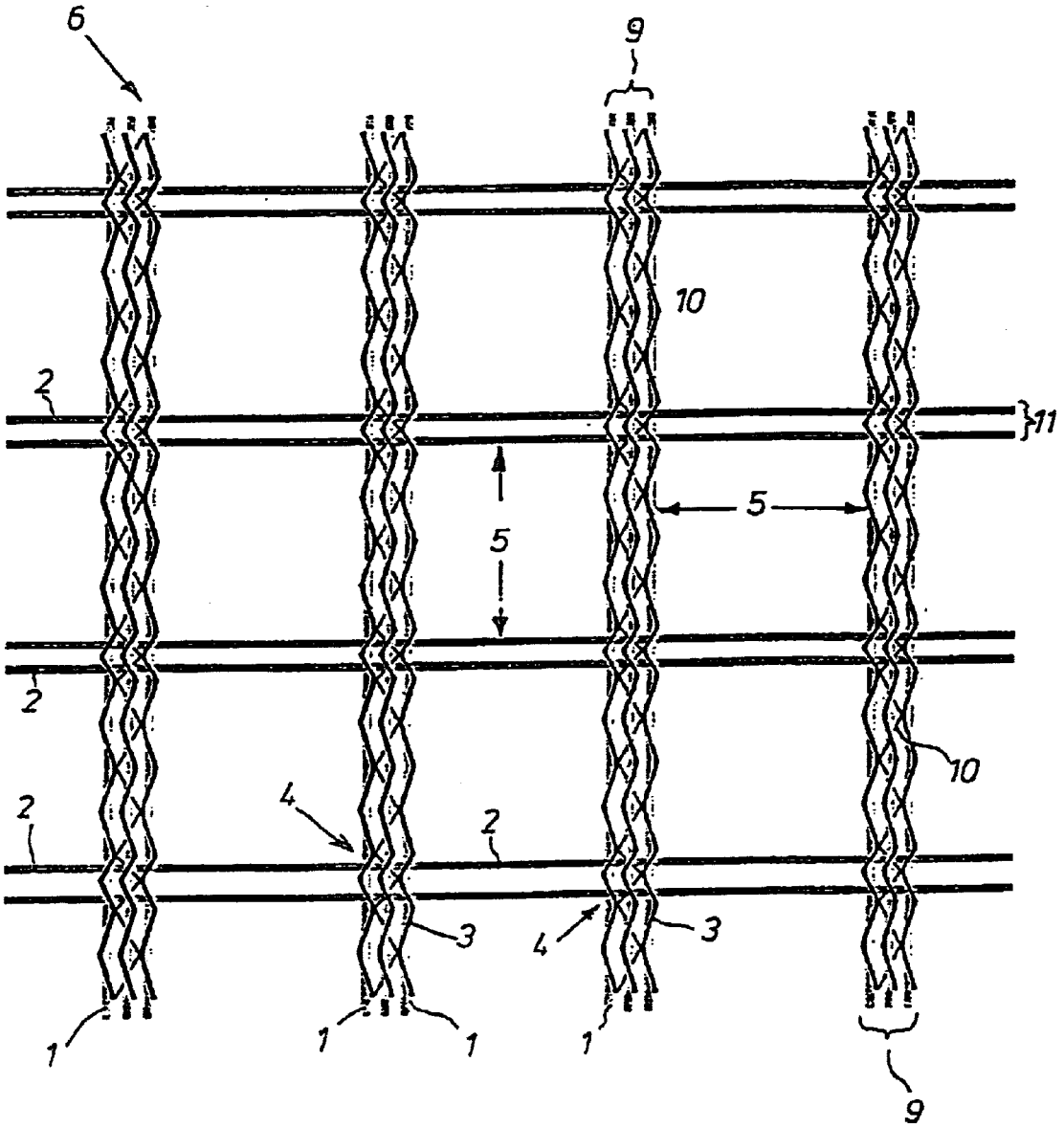
FIG. 1 is a diagrammatic view of the textile mesh structure, in accordance with the invention.

The textile mesh structure shown in FIG. 1 is composed of linearly extending warp threads 1 and weft threads 2 which extend at a right angle to the warp threads 1. Each three warp threads 1 are combined to form a respective warp thread group 9. In addition each two weft threads 2 are combined to form a respective weft thread group 11. The weft threads 2 are joined to the warp threads 1 by means of fixing threads 3 which are knitted thereon. The meshes of the fixing threads 3 extend in a zig-zag configuration over the warp threads 1. The warp thread groups 9 and the weft thread groups 11 are arranged at relatively large spacings which afford the internal widths 5 of the mesh 6.

In accordance with the invention, in the regions 4 in which the weft threads 2 cross the warp threads 1, the lengths 8' of the meshes 7' of the fixing threads 3 are markedly shorter than in the regions therebetween of the mesh structure.

Figure 2:
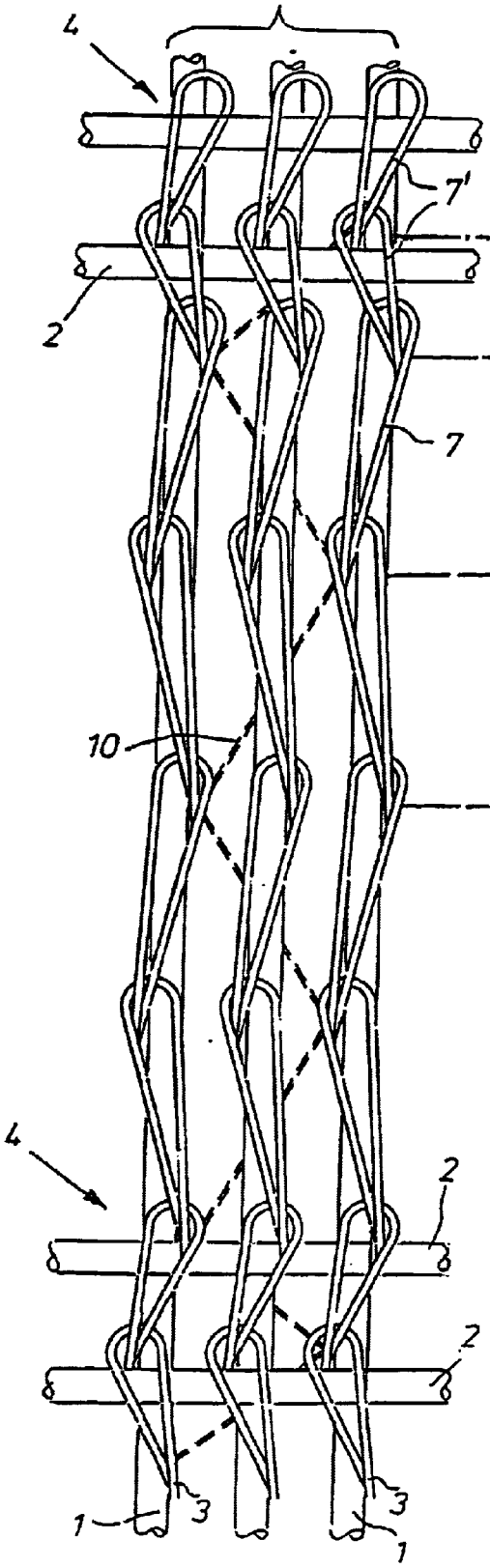
FIG. 2 is a view on an enlarged scale of a register round or repeat of the mesh structure from one side.
Figure 3:
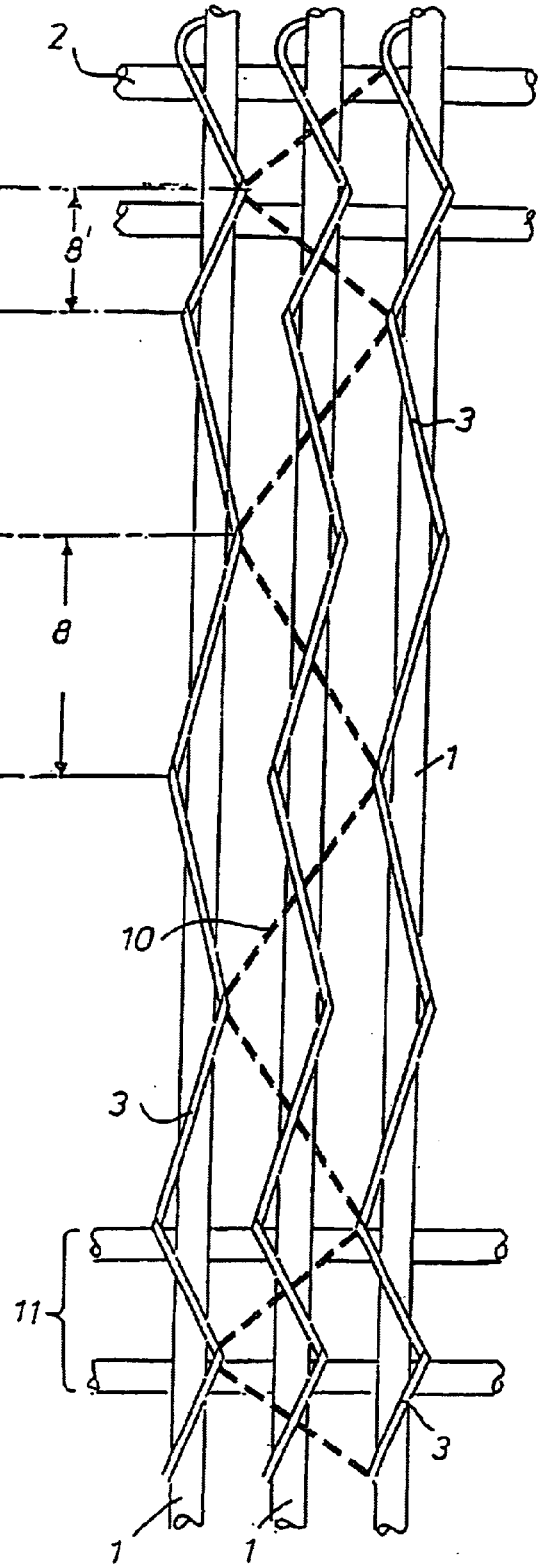
FIG. 3 is a view on an enlarged scale of a register round or repeat of the mesh structure from the other side.

As FIGS. 2 and 3 in particular show the lengths 8' of the meshes 7' or the threads loops of the fixing threads 3 in the regions 4 in which the weft threads 2 intersect the warp threads 1 are at least 30% and preferably 50% shorter than the lengths 8 of the meshes 7 between the intersection regions 4. In the intersection regions 4, a mesh 7' of the fixing threads 3 can be associated with each weft thread 2 per warp thread 1.

So that the warp threads 1 are secured to prevent lateral displacement thereof, a joining yarn 10 is applied by a Raschel knitting procedure, for holding the warp threads 1 of a warp thread group 9 together or securing them to prevent lateral displacement. That joining yarn 10 can either extend around the warp threads 1 of a warp thread group 9 in a zig-zag configuration or, as shown in FIGS. 2 and 3, the fixing threads 3 of each warp thread group 9. It is however also possible for the warp threads 1 of a warp thread group 9 to be secured to prevent lateral displacement by the fixing threads 3 of a warp thread group 9 changing by tricot thread laying from one warp thread 1 of a warp thread group 9 to the adjacent warp thread 1 of the same warp thread group 9.

The textile mesh structure according to the invention can also be combined in known manner with a non-woven material layer.

LIST OF REFERENCES

1 warp threads
2 weft threads
3 fixing threads
4 intersection region
5 internal width
6 mesh structure
7 mesh
7' mesh in the region of the intersection 4
8 length of the mesh 7
8' length of the mesh 7'
9 warp thread group
10 joining yarn
11 weft thread group

What is claimed is:

1. A textile mesh structure comprising:

linearly extending warp threads;

linearly extending weft threads positioned substantially at a right angle to said warp threads;

fixing threads arranged to join said warp and weft threads, said fixing threads being applied by warp knitting to form thread meshes;

said thread meshes being arranged to extend around said warp threads over an entire length of said warp threads and around said weft threads in regions in which said warp threads and weft threads intersect;

said warp threads and said weft treads being arranged one of individually or in groups at relatively large spacings in order to form internal widths; and in said regions in which said warp threads and said weft threads intersect, lengths of said thread meshes are shorter than in regions between intersect regions.

2. The mesh structure in accordance with claim 1, wherein said textile mesh structure is structured as a geomesh.

3. The mesh structure in accordance with claim 1, wherein said lengths of said thread meshes in said intersect regions are at least 30% shorter than said lengths of the meshes between said intersect regions.

4. The mesh structure in accordance with claim 1, wherein, in said intersect regions, said lengths of said thread meshes are structured and arranged such that a mesh is associated with each weft thread.

5. The mesh structure in accordance with claim 4, wherein said weft threads are arranged in weft thread groups comprising a plurality of weft threads, and said lengths of said thread meshes are structured and arranged such that a mesh is associated with each weft thread of said weft thread group.

6. The mesh structure in accordance with claim 1, wherein a fixing thread is associated with each warp thread to form a warp mesh.

7. The mesh structure in accordance with claim 1, wherein said warp threads are arranged in warp groups including at least two warp threads positioned in closer relation to each other than to adjacent warp groups.

8. The mesh structure in accordance with claim 7, further comprising a joining thread arranged in a zig-zag configuration to prevent lateral displacement of said warp threads of said warp group.

9. The mesh structure in accordance with claim 7, wherein each fixing thread of said warp group is associated with each warp thread.

10. The mesh structure in accordance with claim 9, further comprising joining threads extending in a zig-zag configuration to prevent lateral displacement of said fixing threads.

11. The mesh structure in accordance with claim 1, further comprising a non-woven material layer, wherein one of joining threads and said fixing threads are one of knitted on and applied by Raschel knitting to join said warp and said weft threads to said non-woven material layer.

12. A process for forming a textile mesh structure comprising:

linearly extending warp threads;

linearly extending weft threads at substantially a right angle to the warp threads; and warp knitting fixing threads to join the warp and weft threads, whereby thread meshes are formed, wherein the thread meshes are arranged to extend around the warp threads over an entire length of the warp threads and around the weft threads in regions in which the warp threads and weft threads intersect, and wherein, in the regions in which the warp threads and the weft threads intersect, lengths of the thread meshes are formed to be shorter than in regions between intersect regions.

13. The process in accordance with claim 12, wherein the warp threads and the weft threads are arranged one of individually and in groups, such that, spacing between threads in a group is smaller than spacing between adjacent groups.

14. The process in accordance with claim 12, further comprising arranging a joining thread in a zig-zag configuration to prevent lateral displacement of the warp threads of a warp group.

15. The process in accordance with claim 12, further comprising arranging a joining thread in a zig-zag configuration to prevent lateral displacement of the fixing threads.

16. The process in accordance with claim 12, further comprising joining the warp and weft threads to a non-woven material layer.

17. The process in accordance with claim 16, wherein the joining includes one of knitting on and applying by Raschel knitting.

18. A textile mesh structure comprising:

linearly extending warp threads;

linearly extending weft threads positioned substantially at a right angle to said warp threads;

fixing threads arranged to join said warp and weft threads, said fixing threads being applied by warp knitting to form thread meshes;

said thread meshes being arranged to extend around said warp threads over an entire length of said warp threads and around said weft threads in regions in which said warp threads and weft threads intersect;

said warp threads and said weft threads being arranged one of individually or in groups at relatively large spacings in order to form internal widths;

in said regions in which said warp threads and said weft threads intersect, lengths of said thread meshes are shorter than in regions between intersect regions; and a non-woven material layer, wherein one of joining threads and said fixing threads are one of knitted on and applied by Raschel knitting to join said warp and said weft threads to said non-woven material layer.

19. A process for forming a textile mesh structure comprising:

linearly extending warp threads;

linearly extending weft threads at substantially a right angle to the warp threads; and warp knitting fixing threads to join the warp and weft treads, whereby thread meshes are formed, wherein the thread meshes are arranged to extend around the warp threads over an entire length of the warp threads and around the weft treads in regions in which the warp threads and weft threads intersect, wherein, in the regions in which the warp threads and the weft threads intersect, lengths of the thread meshes are formed to be shorter than in regions between intersect regions, and joining the warp and weft threads to a non-woven material layer.

20. A textile mesh structure comprising:

linearly extending warp threads;

linearly extending weft threads positioned substantially at a right angle to said warp threads;

fixing threads joining said warp and weft threads;

each fixing thread extends around each warp thread over an entire length of each warp thread and around each weft thread in regions in which said warp threads and weft threads intersect, wherein said fixing threads are applied by warp knitting to form thread meshes along each warp thread and around each weft thread in regions in which said warp threads and weft threads intersect;

said warp threads and said weft threads being arranged in groups;

in regions in which said warp threads and said weft threads intersect, lengths of the thread meshes are shorter than in regions between the regions in which said warp threads and said weft threads intersect;

spacings having internal widths being defined by the regions between the regions in which said warp threads and said weft threads intersect; and each group of warp threads being joined together by a joining thread, wherein the internal widths are greater than widths of the groups of said warp threads and said weft threads.

* * * * *